US011098433B2

(12) United States Patent
Jiang et al.

(10) Patent No.: US 11,098,433 B2
(45) Date of Patent: Aug. 24, 2021

(54) WASHING MACHINE

(71) Applicant: Wuxi Little Swan Electric Co. Ltd., Wuxi (CN)

(72) Inventors: Tao Jiang, Wuxi (CN); Kyunghag Kim, Wuxi (CN); Deyuan Wu, Wuxi (CN); Shuai Tong, Wuxi (CN); Changxing Zhao, Wuxi (CN); Lufu Tan, Wuxi (CN); Xin Yu, Wuxi (CN); Zhigang Liu, Wuxi (CN); Hucheng He, Wuxi (CN)

(73) Assignee: WUXI LITTLE SWAN ELECTRIC CO., LTD., Wuxi (CN)

( * ) Notice: Subject to any disclaimer, the term of this patent is extended or adjusted under 35 U.S.C. 154(b) by 173 days.

(21) Appl. No.: 16/426,904

(22) Filed: May 30, 2019

(65) Prior Publication Data

US 2019/0276968 A1 Sep. 12, 2019

Related U.S. Application Data

(63) Continuation of application No. PCT/CN2017/078464, filed on Mar. 28, 2017.

(30) Foreign Application Priority Data

Nov. 30, 2016 (CN) ..... 201611087460.8
Nov. 30, 2016 (CN) ..... 201621306505.1

(51) Int. Cl.
*D06F 37/22* (2006.01)
*D06F 23/02* (2006.01)
(Continued)

(52) U.S. Cl.
CPC ..... *D06F 37/22* (2013.01); *D06F 23/02* (2013.01); *D06F 37/28* (2013.01); *D06F 39/12* (2013.01); *D06F 39/14* (2013.01)

(58) Field of Classification Search
CPC ..... D06F 23/02; D06F 37/22; D06F 37/28; D06F 39/12; D06F 39/14
See application file for complete search history.

(56) References Cited

U.S. PATENT DOCUMENTS 2,639,601 A * 5/1953 Miller ..... D06F 37/14 68/139
3,328,984 A * 7/1967 Lowes ..... D06F 95/00 68/12.23
(Continued)

FOREIGN PATENT DOCUMENTS

CN 2330676 Y 7/1999
CN 104313830 A 1/2015
(Continued)

OTHER PUBLICATIONS

Wuxi Little Swan Company Limited, International Search Report and Written Opinion, PCT/CN2017/078464, dated Sep. 6, 2017, 18 pgs.
Wuxi Little Swan Company Limited, Extended European Search Report, EP17876714.1, dated Oct. 21, 2019, 6 pgs.
Wuxi Little Swan Company Limited, Notice of Reasons for Refusal, JP2019-542763, dated Mar. 17, 2020, 6 pgs.

*Primary Examiner* — Joseph L. Perrin
(74) *Attorney, Agent, or Firm* — Morgan, Lewis & Bockius LLP

(57) ABSTRACT

A washing machine (100), comprising a support frame (1), the support frame (1) comprising a door support (11); a drum (2) being arranged on the support frame (1) in a manner enabling rotation around the central axis of rotation; a door (3) being arranged on the door support (11) in a manner enabling rotation around the central axis of rotation; and a pushing plate (4), connected respectively to the door (3) and the drum (2) when in a first state, and being spaced apart from at least one of the door (3) and the drum (2) when in a second state.

8 Claims, 7 Drawing Sheets

(51) Int. Cl.

| | |
|---|---|
| ***D06F 39/14*** | (2006.01) |
| ***D06F 39/12*** | (2006.01) |
| ***D06F 37/28*** | (2006.01) |

(56) References Cited

U.S. PATENT DOCUMENTS

| | | | | |
|---|---|---|---|---|
| 3,498,089 | A * | 3/1970 | Beebe | D06F 37/28 68/139 |
| 2004/0129035 | A1* | 7/2004 | Chang | D06F 37/42 68/23 R |
| 2006/0086151 | A1* | 4/2006 | Kim | D06F 39/14 68/196 |
| 2006/0086152 | A1* | 4/2006 | Kim | D06F 39/14 68/196 |
| 2007/0261448 | A1* | 11/2007 | Ho | D06F 37/22 68/140 |
| 2012/0042697 | A1* | 2/2012 | Hong | D06F 33/00 68/12.23 |
| 2018/0340286 | A1* | 11/2018 | Kim | D06F 37/10 |

FOREIGN PATENT DOCUMENTS

| | | | |
|---|---|---|---|
| CN | 104695165 | A | 6/2015 |
| CN | 104313830 | B | 8/2016 |
| CN | 205474430 | U | 8/2016 |
| CN | 205557087 | U | 9/2016 |
| JP | 2004113480 | A | 4/2004 |
| JP | 3196947 | U | 4/2015 |
| WO | WO2012/085823 | A1 | 6/2012 |

* cited by examiner

WASHING MACHINE

CROSS-REFERENCE TO RELATED APPLICATIONS

This patent application is a continuation application of PCT Patent Application No. PCT/CN2017/078464, entitled "WASHING MACHINE" filed on Mar. 28, 2017, which claims priority to (i) Chinese Patent Application No. 201611087460.8, entitled "WASHING MACHINE" filed with Chinese Patent Office on Nov. 30, 2016, and (ii) Chinese Patent Application No. 201621306505.1, entitled "WASHING MACHINE" filed with Chinese Patent Office on Nov. 30, 2016, all of which are incorporated herein by reference in their entirety.

TECHNICAL FIELD

The present disclosure relates to a technical field of household appliances, in particular to a washing machine.

BACKGROUND

In order to achieve a 720° washing, a door assembly and a tub assembly need to rotate synchronously. In the related art, the door assembly is directly fixed to the tub assembly, and thus, the door assembly and the tub assembly can rotate synchronously under action of a jacking ram. However, when the washing machine is washing or dehydrating, the tub assembly heavily vibrates, which will cause the door assembly and a front sealing door to collide.

SUMMARY

The present disclosure aims to solve at least one of the technical problems in the prior art. Accordingly, an objective of the present disclosure is to provide a washing machine, which has reduced vibration and shaking.

The washing machine according to the embodiments of the present disclosure includes: a support frame including a door support; a tub arranged on the support frame rotatably around a rotation center shaft; a door arranged on the door support rotatably around the rotation center shaft, and the door being configured to open or close the tub; a push plate configured to switch between a first state and a second state. The push plate is connected to the door and the tub respectively in the first state such that the tub drives the door to rotate, and the push plate is separated from at least one of the door and the tub in the second state.

In the washing machine according to embodiments of the present disclosure, by switching the push plate between the first state and the second state, the vibration of the tub can be prevented from being transmitted to the door, which reduces the shaking and vibration of the door, thereby satisfying the user's requirements.

Furthermore, the washing machine according to the embodiments of the present disclosure further includes following additional technical features.

According to some embodiments of the present disclosure, one of the door and the door support is provided with a rail groove extending in a direction surrounding the rotation center shaft, and the other one of the door and the door support is provided with a sliding shaft slidably engaging the rail groove.

Furthermore, the sliding shaft is provided with a roller bearing, and the roller bearing has an inner race connected to the sliding shaft and an outer race movably arranged in the rail groove.

According to the embodiments of the present disclosure, the door support is provided with the rail groove extending in the direction surrounding the rotation center shaft, and the door is provided with the sliding shaft slidably engaging the rail groove.

Furthermore, the door support includes: a rail cover; a rail plate stacked and mounted on the rail cover in a fixed relative position, the rail groove being formed in the rail plate. The sliding shaft is provided with a roller bearing. The roller bearing has an inner race connected to the sliding shaft and an outer race movably arranged in the rail groove and abutting against the door support. The door support is provided with a relief groove for spacing apart the inner race of the roller bearing from the rail cover.

According to some embodiments of the present disclosure, the door support is provided with one rail groove or a plurality of the rail grooves arranged at intervals, and a plurality of the sliding shafts are provided in one-to-one correspondence with the rail grooves.

According to some embodiments of the present disclosure, the push plate is mounted to the tub in a fixed relative position. The rail groove extends in an up and down direction. The push plate has a pushing portion located below the sliding shaft and configured to push the sliding shaft upwards. The push plate is in the second state when the sliding shaft is located at a lower end of the rail groove.

Furthermore, when the tub is in a lower limit position, an included angle between a connecting line L1 from the rotation center shaft to the pushing portion and a connecting line L2 from the rotation center shaft to the lower end of the rail groove is in a range of 0° to 5°.

According to some embodiments of the present disclosure, the door support is arranged at each of a left side and a right side of the door, and each of a left end and a right end of the door is slidably connected to the corresponding door support.

According to some embodiments of the present disclosure, the push plate is arranged at each of a left side and a right side of the tub.

Additional aspects and advantages of the present disclosure will be given in the following description, some of which will become apparent from the following description or be learned from practices of the present disclosure.

BRIEF DESCRIPTION OF THE DRAWINGS

The above and/or additional aspects and advantages of the present disclosure will become apparent and easy to understand from descriptions of the embodiments with reference to the drawings, in which.

Figure 1:
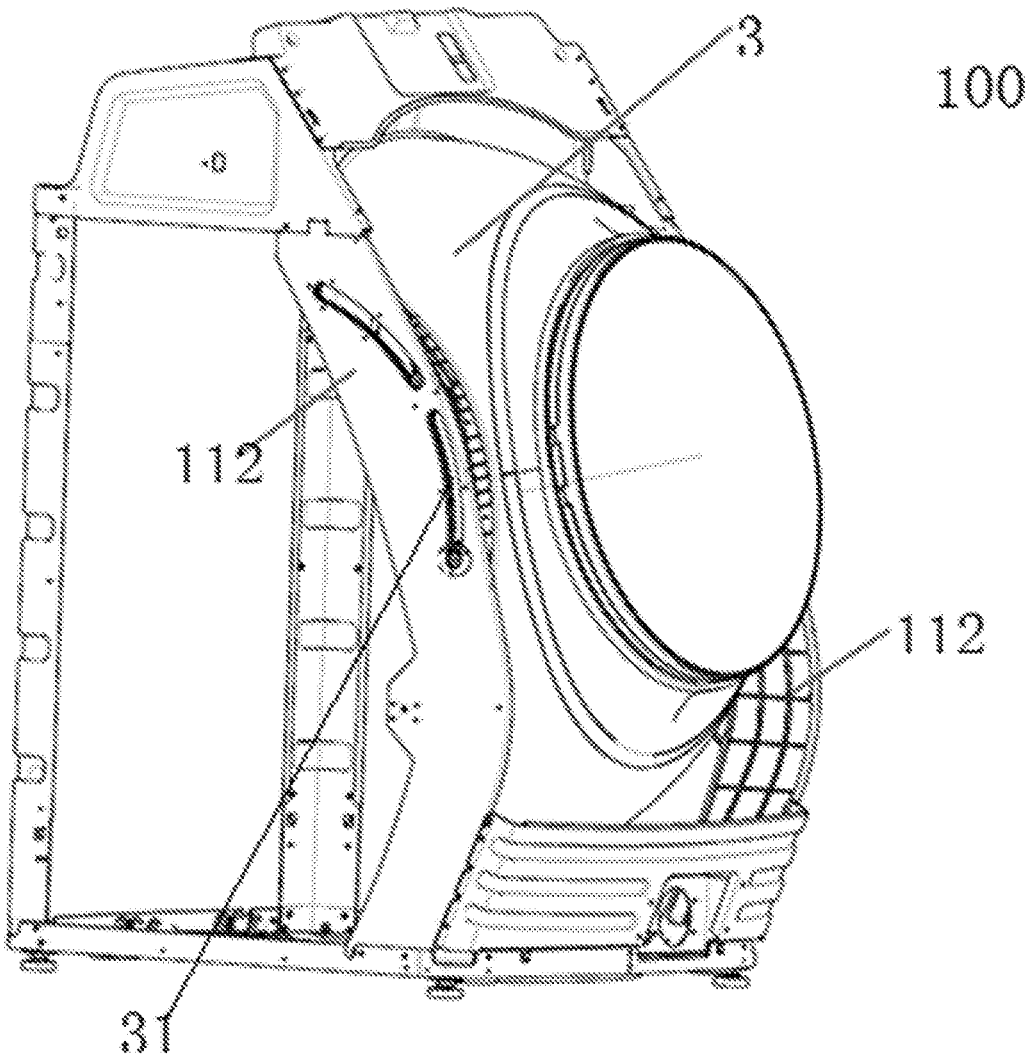
FIG. 1 is a partial schematic view of a washing machine according to an embodiment of the present disclosure.
Figure 2:
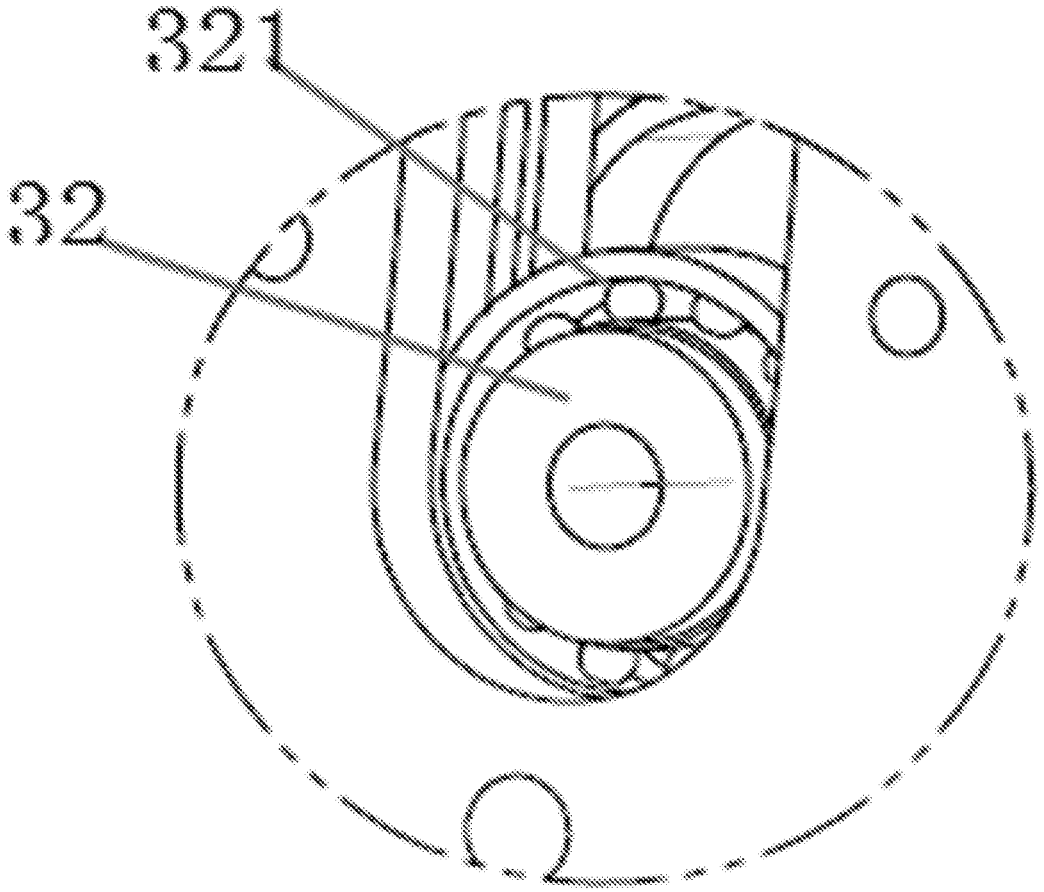
FIG. 2 is a partial enlarged view of FIG. 1.

REFERENCE SIGNS washing machine 100,
support frame 1, door support 11, rail cover 111, rail plate 112,
tub 2,
door 3, rail groove 31, sliding shaft 32, roller bearing 321, push plate 4, pushing portion 41,
electric push rod 5.

DETAILED DESCRIPTION

Embodiments of the present disclosure will be described in detail and examples of the embodiments will be illustrated in the accompanying drawings. The same or similar elements and the elements having same or similar functions are denoted by like reference numerals throughout the descriptions. The embodiments described herein with reference to the drawings are explanatory, which aim to illustrate the present disclosure, but shall not be construed to limit the present disclosure.

A washing machine 100 according to embodiments of the present disclosure will be described in detail with reference to FIGS. 1 to 6.

The washing machine 100 according to embodiments of the present disclosure includes a support frame 1, a tub 2, a door 3 and a push plate 4.

Figure 3:
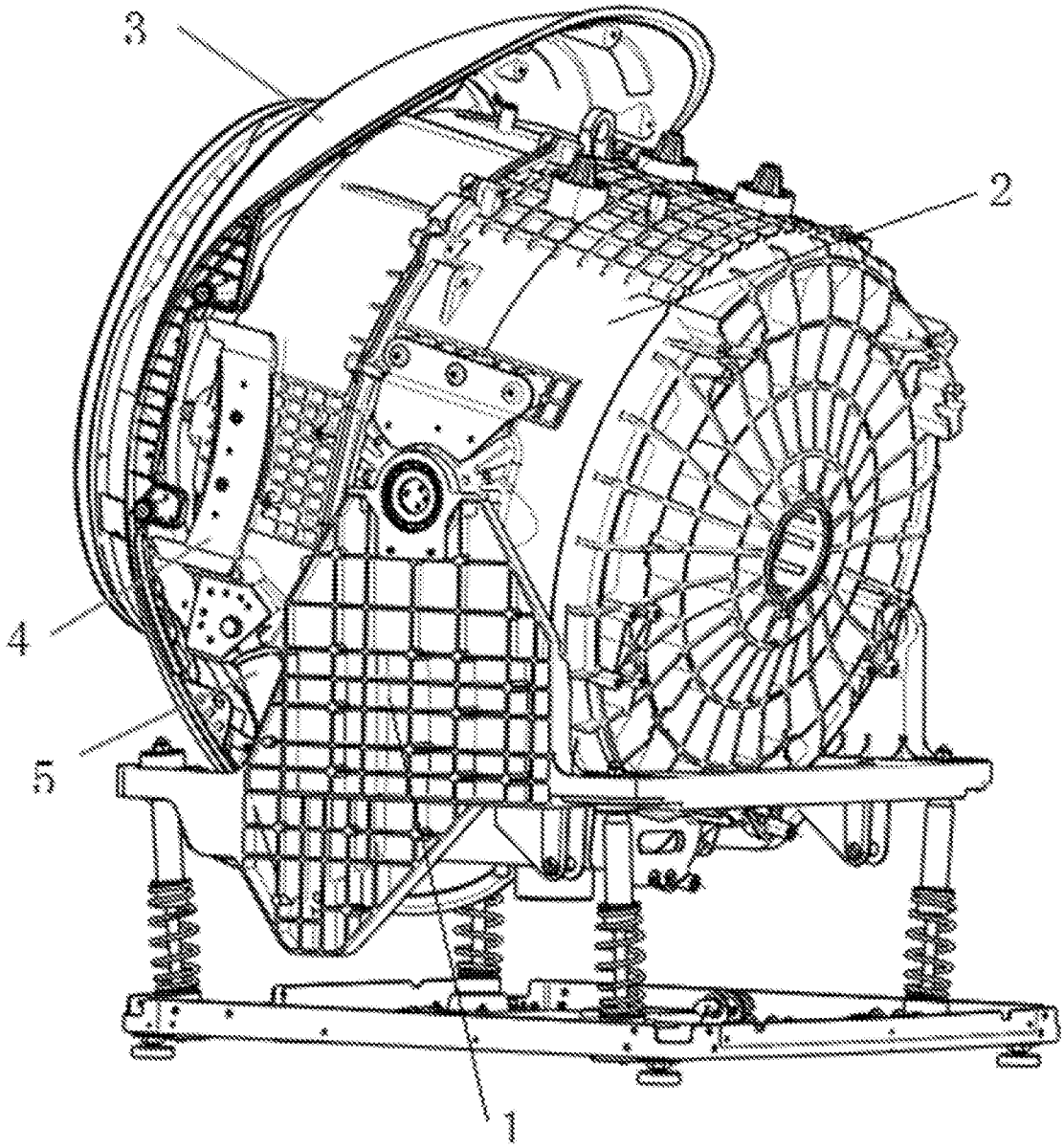
FIG. 3 is a partial schematic view of the washing machine in another direction according to the embodiment of the present disclosure.
Figure 4:
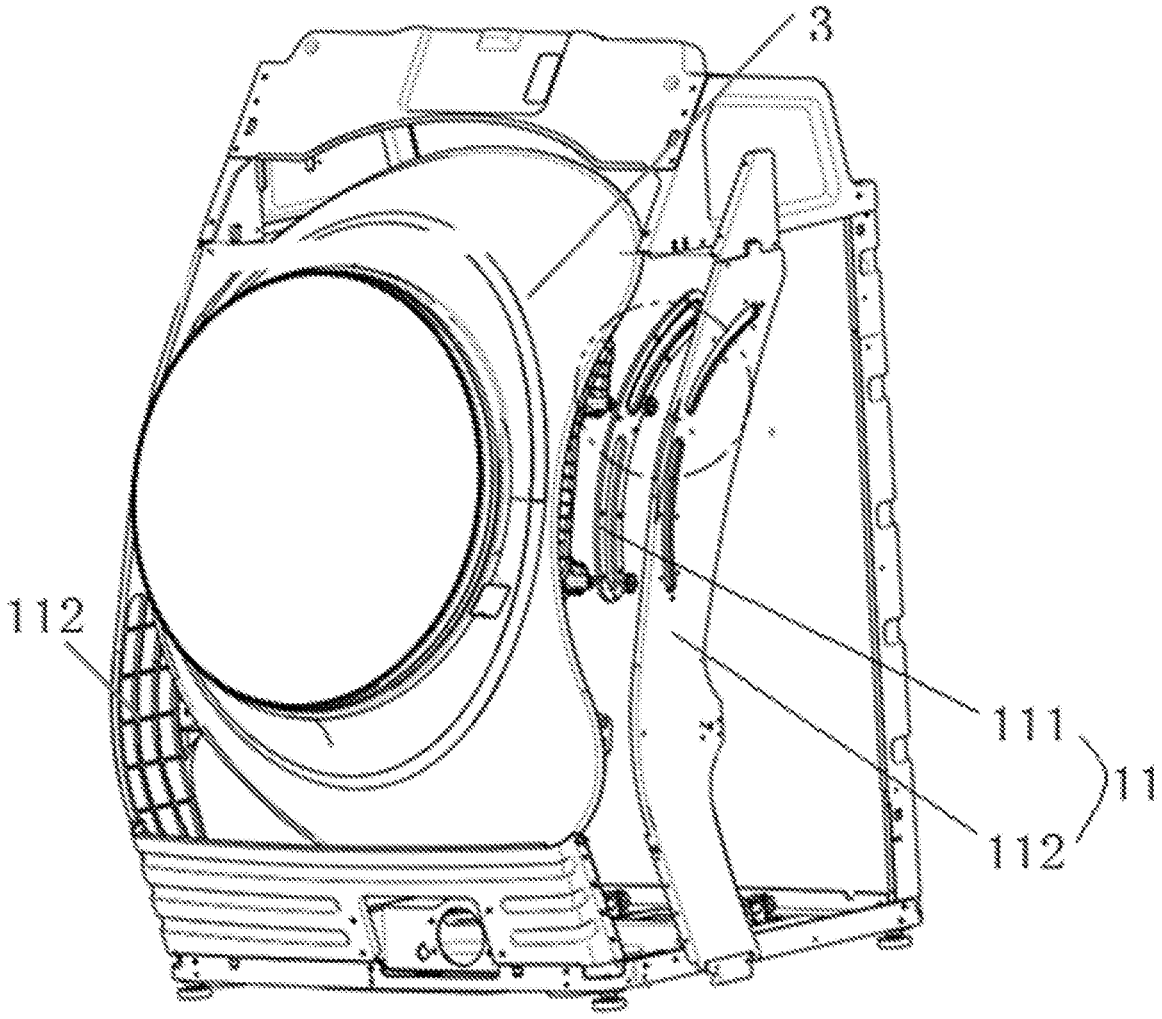
FIG. 4 is a partial schematic view of the washing machine in still another direction according to the embodiment of the present disclosure.
Figure 6:
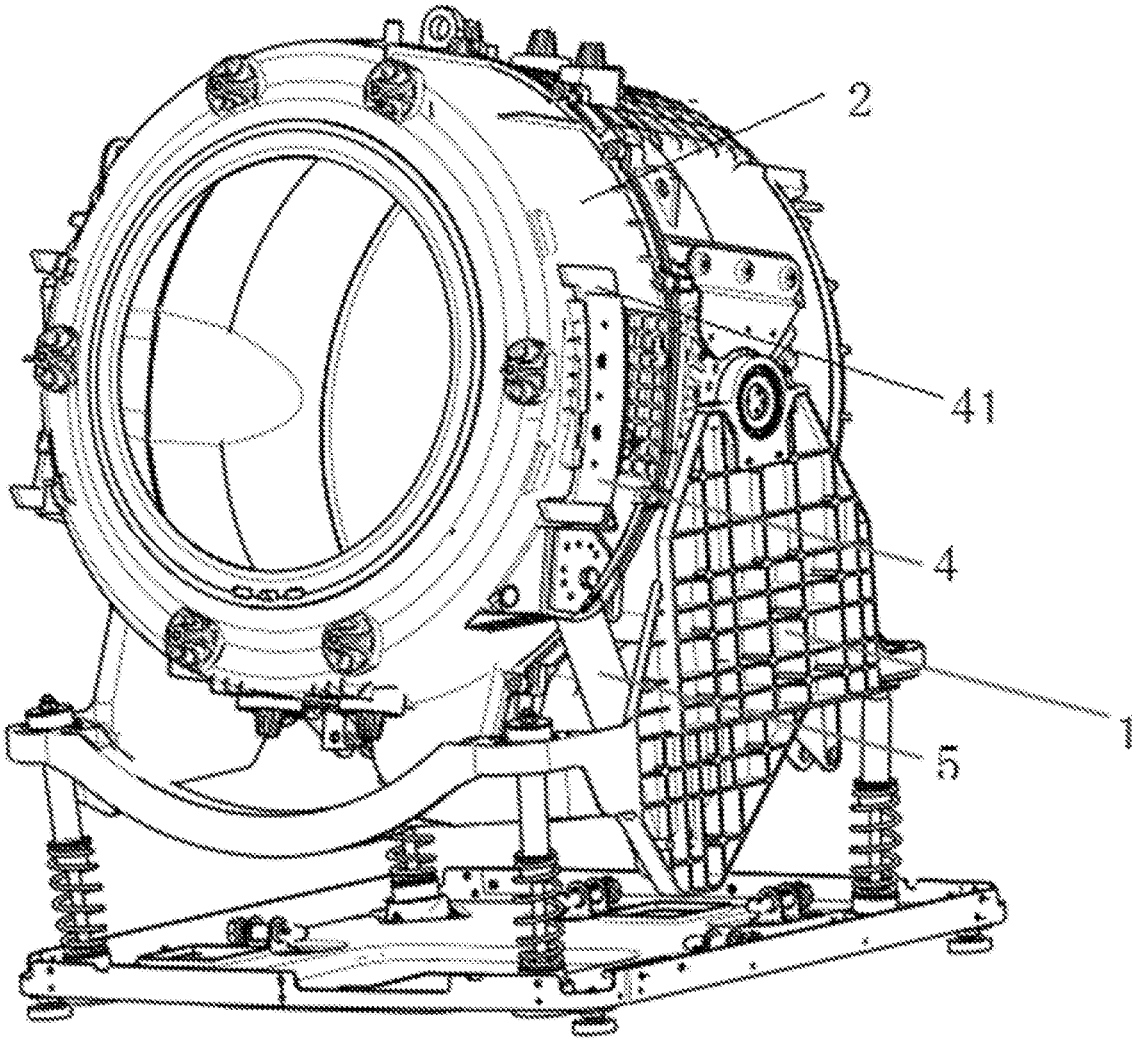
FIG. 6 is a schematic view of the washing machine according to the embodiment of the present disclosure.
Figure 7:
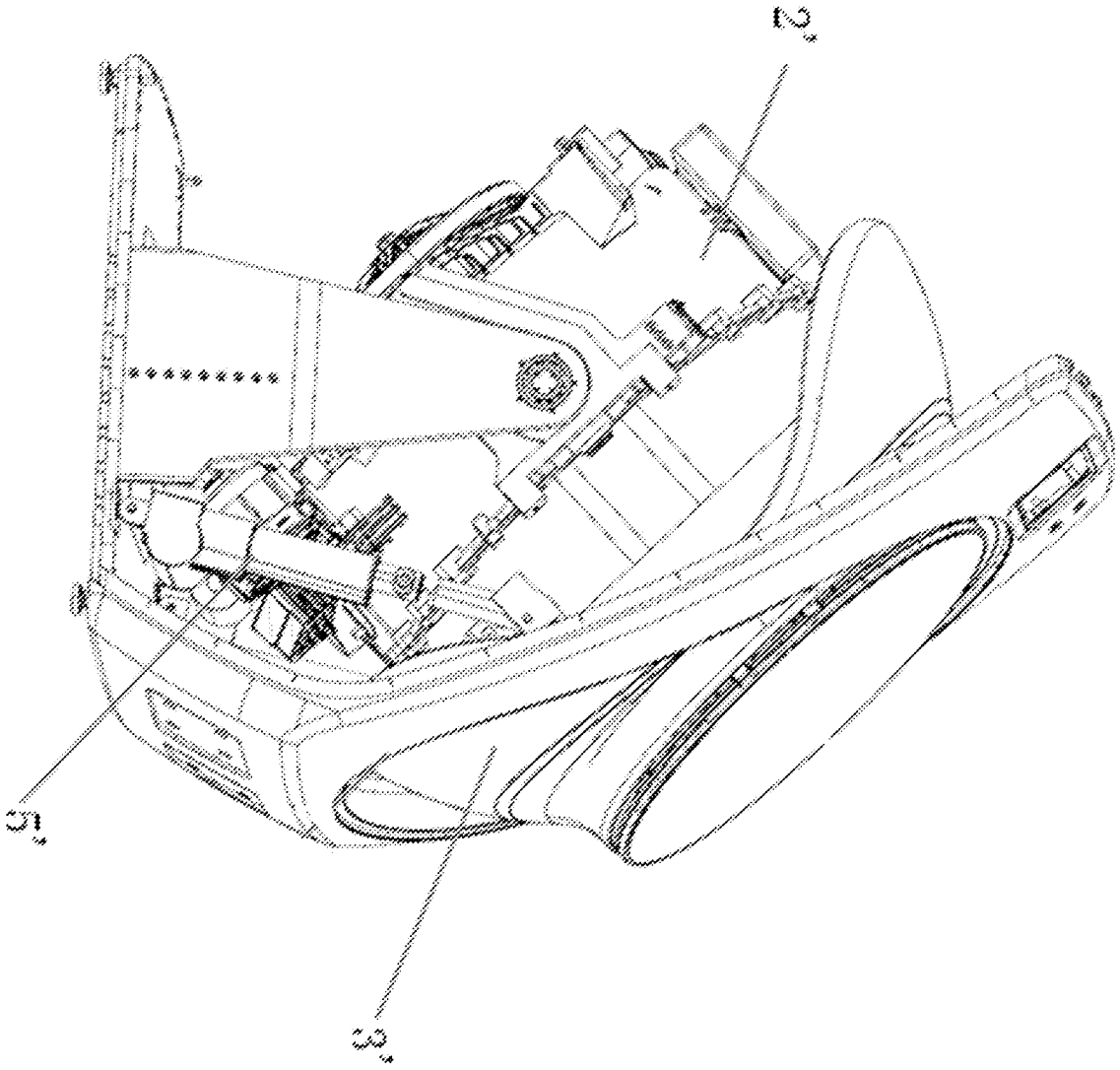
Fig. 7 (Prior Art)
FIG. 7 is a partial schematic view of a washing machine in the prior art.

Specifically, referring to FIGS. 3, 4 and 6, the support frame 1 includes a door support 11. The door support 11 is used to support the door 3. The tub is arranged on the support frame rotatably around a rotation center shaft such that the support frame 1 can reliably support the tub 2.

The door 3 is arranged on the door support 11 rotatably around the rotation center shaft, and the door 3 is configured to open or close the tub 3. Thus, when the door 3 is opened, it is convenient for a user to put clothes to be washed into the tub 2 or to take the clothes which have been washed out of the tub 2. When the tub 2 is closed, the clothes inside the tub 2 can be washed.

The push plate 4 can switch between a first state and a second state. The push plate 4 is connected to the door 2 and the tub 3 respectively in the first state such that the tub 2 drives the door 3 to rotate. That is, when the push plate 4 is in the first state, the push plate 4 is connected to the door 3 and the push plate 4 is also connected to the tub 2, such that the tub 2 can drive the door 3 to rotate, which improves washing of the clothes.

It can be understood that the connection between the push plate 4 and the door 3 and the connection between the push plate 4 and the tub 2 in the first state include a mechanical connection or an attraction connection by means of magnets, etc.

The push plate 4 is separated from at least one of the door and the tub in the second state. In other words, when the push plate 4 is in the second state, the push plate 4 may be separated from the door 3, the push plate 4 may be separated from the tub 2, or the push plate 4 may be separated from both the door 3 and the tub 2. As a result, the vibration and the shaking of the washing machine 100 are reduced during the washing process of the washing machine 100, and thus the user's requirements are better satisfied.

It should be noted that the rotation center shaft of the tub 2 is collinear with the rotation center shaft of the door 3, such that it is ensured that the door 3 and the tub 2 can rotate synchronously around the rotation center shaft. The rotation center shaft may be perpendicular to an axis of the tub 2, and the rotation center axis shaft is coplanar with the axis of the tub 2.

In the washing machine 100 according to embodiments of the present disclosure, by switching the push plate 4 between the first state and the second state, the vibration of the tub 2 can be prevented from being transmitted to the door 3, thereby reducing the shaking and vibration of the door 3 and better satisfying the user's requirements.

Figure 5:
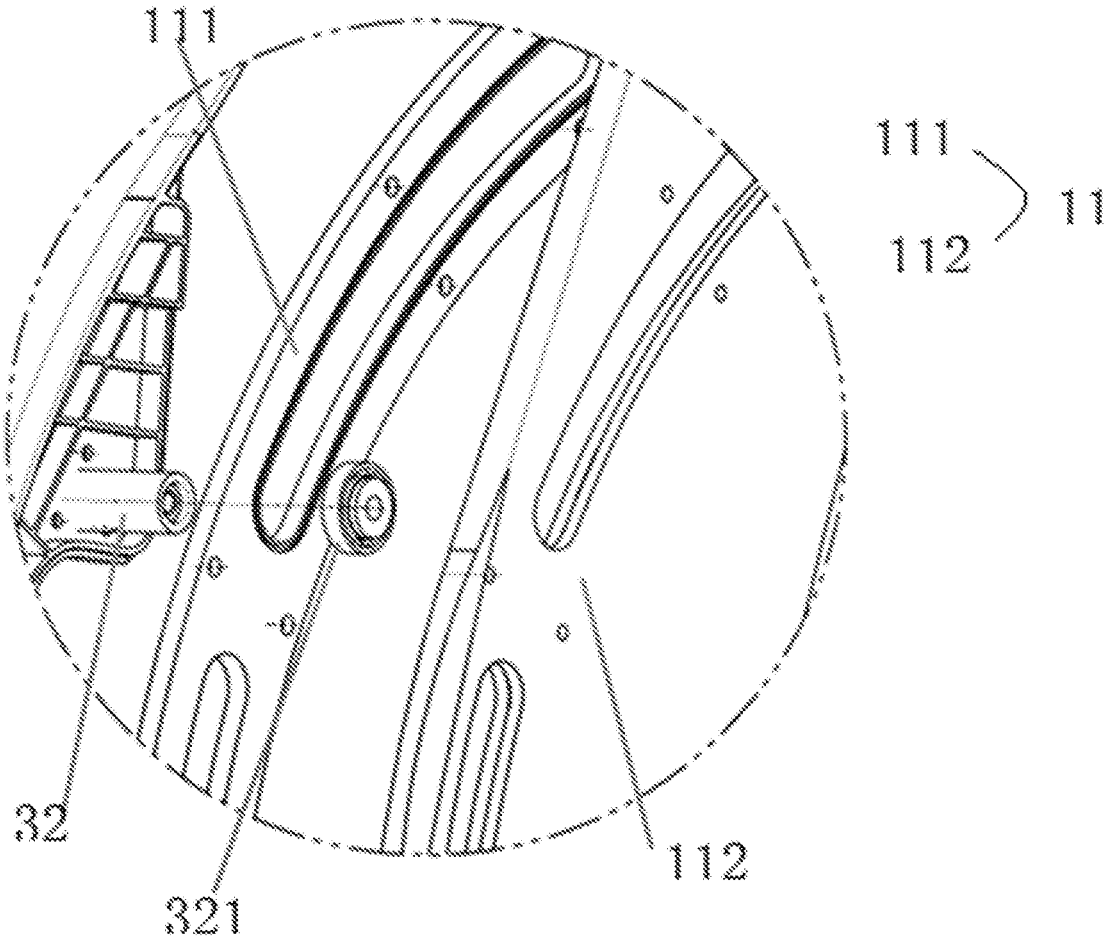
FIG. 5 is a partial enlarged view of FIG. 4.

As illustrated in FIGS. 1, 4 and 5, according to some embodiments of the present disclosure, one of the door 3 and the door support 11 is provided with a rail groove 31 extending in a direction surrounding the rotation center shaft, and the other one of the door 3 and the door support 11 is provided with a sliding shaft 32 slidably engaging the rail groove 31. Through the fit of the sliding shaft 32 and the rail groove 31, the rotation of the door 3 on the door support 3 can be achieved, which reduces the transmission of the vibration to some degree.

For example, the door 3 may be provided with the rail groove 31 extending in the direction surrounding the rotation center shaft, and the door support 11 may be provided with the sliding shaft 32 slidably engaging the rail groove 31. Alternatively, the door support 11 may be provided with the rail groove 31 extending in the direction surrounding the rotation center shaft, and the door 3 may be provided with the sliding shaft 32 slidably engaging the rail groove 31. It is possible to adaptively configure specific positions and arrangement manners of the sliding shaft 32 and the rail groove 31 according to practical requirements.

Furthermore, the sliding shaft 32 is provided with a roller bearing 321, and an inner race of the roller bearing 321 is connected to the sliding shaft 32, which realizes a connection between the roller bearing 321 and the sliding shaft 32. Moreover, an outer race of the roller bearing 321 is movably arranged in the rail groove 31. Therefore, by providing the roller bearing 321, the sliding of the sliding shaft 32 along the rail groove 31 can be smoothly achieved.

According to some embodiments of the present disclosure, the door support 11 is provided with the rail groove 31 extending in the direction surrounding the rotation center shaft, and the door 3 is provided with the sliding shaft 32 slidably engaging the rail groove 31. Thus, with the fit of the sliding shaft 32 and the rail groove 31, the sliding of the door 3 on the door support 3 is achieved, which facilitates the washing of the clothes.

Furthermore, as illustrated in FIGS. 4 and 5, the door support 11 includes a rail cover 111 and a rail plate 112. The rail plate 112 is stacked and mounted on the rail cover 111 in a fixed relative position, and the rail groove 31 is formed in the rail plate 112. That is, the rail plate 112 and the rail cover 111 are stacked, and a relative position of the rail plate 112 and the rail cover 111 is fixed. Further, the rail plate 112 is provided with the rail groove 31 therein.

The sliding shaft 32 is provided with the roller bearing 321. The inner race of the roller bearing 321 is connected to the sliding shaft 32. The outer race of the roller bearing 321 is movably arranged in the rail groove 31 and abuts against the door support 11. The door support 11 is provided with a relief groove for spacing apart the inner race of the roller bearing 321 from the rail cover 111. Thus, it is easy to achieve the sliding of the door 3 on the door support 11.

The rail cover 111 may be stacked on an inner side or an outer side of the rail plate 112, and the rail plate 112 and the rail cover 111 may be fixed by means of a screw connection.

Moreover, the rail groove 31 may be defined by the rail cover 111 and the rail plate 112 together. The rail groove 31 may be used to accommodate the roller bearing 321.

As illustrated in FIGS. 1 and 5, according to some embodiments of the present disclosure, the door support 11 may be provided with one rail groove 31 or a plurality of the rail grooves 31 arranged at intervals, and a plurality of the sliding shaft 32 are provided in one-to-one correspondence with the rail grooves 31. Therefore, the sliding of the door 3 on the door support 11 is achieved, thereby contributing to reduction of the vibration and shaking of the washing machine 100.

Specifically, the door support 11 may be provided with one rail groove 31 and the sliding shaft 32 corresponds to the rail groove 31. Thus, with the fit of the sliding shaft 32 and the rail groove 31, the sliding of the door 3 on the door support 3 is achieved.

Alternatively, the door support 11 may be provided with a plurality of the rail grooves 31 arranged at intervals, and a plurality of the sliding shaft 32 are provided in one-to-one correspondence with the rail grooves 31. Therefore, the stability of the door 3 sliding on the door support 11 is increased, thus facilitating reduction of the vibration and shaking.

The rail groove 31 may be an arc groove extending in an up and down direction.

As illustrated in FIGS. 6 and 1, according to some embodiments of the present disclosure, the push plate 4 is mounted to the tub 2 in a fixed relative position. The rail groove 31 extends in the up and down direction. The push plate 4 includes a pushing portion 41 located below the sliding shaft 32 and configured to push the sliding shaft 32 upwards. Therefore, since the push plate 4 can push the sliding shaft 32 to move upwards, the synchronous rotation of the tub 2 and the door 3 is achieved.

The push plate 4 is in the second state when the sliding shaft 32 is located at a lower end of the rail groove 31. When the push plate 4 is in the second state, the push plate 4 is separated from at least one of the door 3 and the tub 2 such that the vibration of the washing machine 100 in the washing process is reduced.

Furthermore, when the tub 2 is in a lower limit position, an included angle between a connecting line L1 from the rotation center shaft to the pushing portion 41 and a connecting line L2 from the rotation center shaft to the lower end of the rail groove 31 is in a range of 0° to 5°. In other words, when the tub 2 is located in the lower limit position, the projection of the rotation center shaft on a plane passing through the axis of the tub 2 and perpendicular to the rotation center shaft is a point. The included angle between the connecting line L1 from the point to the pushing portion 41 and the connecting line L2 from the point to the lower end of the rail groove 31 is in the range of 0° to 5°. Accordingly, the pushing portion 41 and the corresponding rail groove 31 are located on the same side of the tub 2.

That is, when the tub 2 is in the lower limit position, the push plate 4 and the sliding shaft 32 are separated, i.e., the push plate 4 and the sliding shaft 32 are not in contact. In this case, the push plate 4 is located below the sliding shaft 32. When the tub 2 rotates by an angle of 0° to 5°, the push plate 4 and the sliding shaft 32 are in contact. The push plate 4 drives the sliding shaft 32 to slide upwards along the rail groove 31 such that the tub 2 and the door 3 synchronously rotate.

The washing machine 100 further includes an electric push rod 5, and the electric push rod 5 pushes the tub 2 to rotate around the rotation center shaft.

The included angle may be 0°, 1°, 2°, 3°, 4° or 5°, and may be adaptively configured according to practical requirements.

According to some embodiments of the present disclosure, the door support 11 is arranged at each of left and right sides of the door 3, and each of left and right ends of the door 3 is slidably connected to the corresponding door support 11. Therefore, the door 3 can rotate relative to the door support 11 more stably, thereby facilitating reduction of the vibration and shaking of the washing machine 100.

As illustrated in FIG. 6, according to some embodiments of the present disclosure, the push plate 4 is arranged on each of left and right sides of the tub 2. Accordingly, the push plates 4 on both left and right sides can push the corresponding sliding shafts 32 on the door 3 respectively, such that the sliding shafts 32 slide along the rail grooves 31, thereby achieving the synchronous rotation of the tub 2 and the door 3.

The tub 2 may be provided with one or more push plates 4 on both left and right sides thereof. For example, the number of the push plates 4 on one side of the tub 2 (for example, the left side or the right side of the push plate 4) may be one, two, three, etc., in which case the push plate 4 can push the door 3 to rotate better.

A specific embodiment of the washing machine 100 according to the present disclosure will be described with reference to the drawings.

By means of four sliding shaft 32 and four roller bearings 321, the door 3 rotates on the rail grooves 31 fixed to both left and right sides of a cabinet (for example, the support frame 1) of the washing machine, and the push plates 4 fixed to both left and right sides of the tub 2 push the door 3. When the electric push rod 5 pushes the tub 2 to rotate, the tub 2 and the door 3 rotate together for washing, under the pushing of the push plates 4 on both left and right sides.

The door 3 is fixed to the door supports 11 on both left and right sides by the four sliding shafts 32 and the four roller bearings 321. The door 3 moves and rotates along the arc rail groove 31 on the door support 11.

Two push plates 4 are provided and fixed on each of left and right sides of the tub 2. When the electric push rod 5 is energized, the tub 2 starts to rotate. When the tub 2 is rotated by 3°, the push plates 4 on the left and right sides carry the door 3 to rotate upwards together along the rail groove 31. When the tub 2 rotates downwards, the door 3 rotates downwards along the rail groove 31 under the self-weight of the door 3. After reaching the lowest point of the rail groove 31, the door 3 stops rotating, while the tub 2 continues rotating downwards by 3° and then stops. Thus, the separation of the tub 2 and the door 3 is achieved (which refers to the separation of the push plate 4 and the sliding shaft 32).

The four sliding shafts 32 are fixed on the door 3, and the four roller bearings 321 are assembled in the rail groove 31. The rail cover 111 is compressed on the roller bearing 321 and fastened by the screw and the rail plate 112. The rail groove 31 and the roller bearing 321 are fastened to the sliding shaft 32 by screws. The push plates 4 on both left and right sides are fixed to the tub 2 by screws. The electric push rod 5 is fixed to the support frame 1 by screws. The movable end of the electric push rod 5 is fixed to the tub 2.

A working process of the washing machine 100 according to embodiments of the present disclosure will be described with reference to FIGS. 1-6.

Specifically, in order to achieve a 720° washing, the tub 2 and the door 3 need to rotate together around the rotation center shaft. In this case, the electric push rod 5 is energized to push the tub 2 to rotate. When the tub 2 is rotated by 3°, the push plates 4 on the left and right sides carry the door 3 to rotate upwards together along the rail groove 31. When the tub 2 rotates downwards, the door 3 rotates downwards along the rail groove 31 under the self-weight of the door 3. After reaching the lowest point of the rail groove 31, the door 3 stops rotating, while the tub 2 continues rotating downwards by 3° and then stops. Thus, the separation of the tub 2 and the door 3 is achieved, such that the vibration of the tub 2 is prevented from being transmitted to the door 3, thereby reducing the shaking and vibration of the door 3.

The 720° washing means that the clothes inside the tub 2 can be washed by 720°. Specifically, when the tub 2 is rotated by 360° around the axis of the tub 2, the clothes inside the tub 2 are washed by 360° along with the tub 2. When the tub 2 is rotated around the rotation center shaft by a predetermined angle (for example, 45°), the clothes inside the tub 2 can be rolled over by 360° along with the tub 2 at this time, thereby achieving the 720° washing of the clothes. The predetermined angle by which the tub 2 is rotated around the rotation center shaft can be adaptively configured according to practical requirements.

The door 3 is fixed to the rail groove 31 by the sliding shaft 32 and the sliding bearing 321 and moves along a specific track. The tub 2 is separated from the door 3 in an initial position. When the tub 2 is rotated by 3°, the push plates 4 on both sides of the tub 2 can be in contact with the door 3 and push the door 3 to rotate together. Therefore, the vibration of the tub 2 is prevented from being transmitted to the door 3, thereby reducing the shaking and vibration of the door 3. The rotation center shaft of the tub 2 and the rotation center shaft of the door 3 are collinear, so that the tub 2 and the door 3 can rotate around the rotation center shaft together for washing. Thus, the working process of the washing machine 100 according to the embodiments of the present disclosure is completed.

Reference throughout this specification to "an embodiment", "some embodiments", "an example", "a specific example", or "some examples" means that a particular feature, structure, material, or characteristic described in connection with the embodiment or example is included in at least one embodiment or example of the present disclosure. In this specification, exemplary descriptions of aforesaid terms are not necessarily referring to the same embodiment or example. Furthermore, the particular features, structures, materials, or characteristics may be combined in any suitable manner in one or more embodiments or examples. In addition, without conflicting, various embodiments or examples or features of various embodiments or examples described in the present specification may be combined by those skilled in the art.

Although embodiments of present disclosure have been shown and described above, it should be understood that above embodiments are just explanatory, and cannot be construed to limit the present disclosure, for those skilled in the art, changes, alternatives, and modifications can be made to the embodiments without departing from the scope of the present disclosure.

What is claimed is:

1. A washing machine, comprising:

a support frame comprising a door support;

a tub arranged on the support frame rotatably around a rotation center shaft;

a door arranged on the door support rotatably around the rotation center shaft, and the door being configured to open or close the tub; and a push plate configured to switch between a first state and a second state, the push plate being fixedly mounted to the tub, the push plate being connected to the door and the tub respectively in the first state, such that the tub drives the door to rotate, and the push plate being separated from at least one of the door and the tub in the second state, wherein a first one of the door and the door support is provided with a rail groove extending in a direction surrounding the rotation center shaft, and a second one of the door and the door support is provided with a sliding shaft slidably engaging the rail groove, and wherein the door support is provided with the rail groove extending in the direction surrounding the rotation center shaft, and the door is provided with the sliding shaft slidably engaging the rail groove.

2. The washing machine according to claim 1, wherein the sliding shaft is provided with a roller bearing, and the roller bearing has an inner race connected to the sliding shaft and an outer race movably arranged in the rail groove.

3. The washing machine according to claim 1, wherein the door support comprises:

a rail cover; and a rail plate fixedly mounted on the rail cover, the rail groove being formed in the rail plate, wherein the sliding shaft is provided with a roller bearing, the roller bearing has an inner race connected to the sliding shaft and an outer race movably arranged in the rail groove and abutting against the door support, and the door support is provided with a relief groove for spacing the inner race of the roller bearing apart from the rail cover.

4. The washing machine according to claim 1, wherein the door support comprises:

one or a plurality of the rail grooves arranged at intervals, a plurality of the sliding shafts being provided in one-to-one correspondence with the plurality of the rail grooves.

5. The washing machine according to claim 1, wherein the rail groove extends in an up and down direction, the push plate having a pushing portion located below the sliding shaft and configured to push the sliding shaft upwards, and the push plate is in the second state when the sliding shaft is located at a lower end of the rail groove.

6. The washing machine according to claim 5, wherein an included angle between a connecting line L1 from the rotation center shaft to the pushing portion and a connecting line L2 from the rotation center shaft to the lower end of the rail groove is in a range of 0° to 5°, when the tub is in a lower limit position.

7. The washing machine according to claim 1, wherein the door support is arranged at each of a left side and a right side of the door, and each of a left end and a right end of the door is slidably connected to the corresponding door support.

8. The washing machine according to claim 1, wherein the push plate is arranged at each of a left side and a right side of the tub.

* * * * *